US006439740B1

(12) United States Patent
Yan

(10) Patent No.: US 6,439,740 B1
(45) Date of Patent: Aug. 27, 2002

(54) LIGHTING FIXTURE HAVING A SCREW LOCK LAMP SUPPORT

(75) Inventor: Ellis Yan, South Russell, OH (US)

(73) Assignee: Technical Consumer Products, Inc., Aurora, OH (US)

( * ) Notice: Subject to any disclaimer, the term of this patent is extended or adjusted under 35 U.S.C. 154(b) by 0 days.

(21) Appl. No.: 09/434,555

(22) Filed: Nov. 8, 1999

Related U.S. Application Data

(63) Continuation-in-part of application No. 09/243,509, filed on Feb. 1, 1999, now Pat. No. 6,206,545, which is a continuation-in-part of application No. 08/980,564, filed on Oct. 1, 1997, now Pat. No. 5,938,316.

(51) Int. Cl.[7] ..... F21S 1/02

(52) U.S. Cl. ..... 362/216; 362/260; 362/265; 362/404; 362/147

(58) Field of Search ..... 362/260, 216, 362/226, 263, 265, 404, 147

(56) References Cited

U.S. PATENT DOCUMENTS

| | | | | |
|---|---|---|---|---|
| 3,742,208 A | | 6/1973 | Mills | |
| 4,029,953 A | | 6/1977 | Natoli | |
| 4,096,554 A | * | 6/1978 | Greene | 362/220 |
| 4,141,061 A | * | 2/1979 | Ford et al. | 362/216 |
| 4,149,226 A | * | 4/1979 | Dalton | 362/216 |
| 4,507,719 A | * | 3/1985 | Quiogue | 362/404 |
| 5,130,915 A | | 7/1992 | Lerch | |
| 5,491,618 A | | 2/1996 | Vakil | |
| 5,938,316 A | * | 8/1999 | Yan | 362/260 |

* cited by examiner

*Primary Examiner*—Thomas M. Sember
(74) *Attorney, Agent, or Firm*—Joseph H. Taddeo

(57) ABSTRACT

A fluorescent lighting fixture having a novel attachment and engaging means, thereby reducing the number of components needed for the manufacture of the lighting fixture, concomitantly reducing the assembly time and assembly costs. The attachment means is comprised of a ballast housing having a threaded portion that engages the mating threaded indentations found the base of the lighting fixture. The ballast housing is rotatably drawn flat, abutting the surface of the fixture base into a binding frictional engagement. A lamp support bracket, securely attached to the end of the ballast housing opposite its mounting base, is bat-winged shaped to allow the fluorescent lamp to be positioned close to the base of the lighting fixture to permit a stylized dome-shaped cover to be snap-fitted to the base of the fixture. The dome-shaped cover, having a circumferential ridge on its skirt, is securely held in place by snapping the cover past three nibs in the base plate, spaced preferably 120 degrees apart.

9 Claims, 7 Drawing Sheets

LIGHTING FIXTURE HAVING A SCREW LOCK LAMP SUPPORT

REFERENCE TO PREVIOUSLY FILED APPLICATIONS

This application is a continuation-in-part of application Ser. No. 09/243,509, filed on Feb. 1, 1999, now U.S. Pat. No. 6,206,545, which is a continuation-in-part of application Ser. No. 08/980,564, filed on Dec. 1, 1997, now U.S. Pat. No. 5,938,316.

FIELD OF THE INVENTION

The present invention relates primarily to a lighting fixture having an illumination source support apparatus and more particularly to a light source support apparatus having an engaging component insertable into a recess and being rotatable therein for attachment.

BACKGROUND OF THE INVENTION

Previously, the prior art disclosed illumination source support brackets that are mounted to the base of a lighting fixture by using self-tapping screws as the hold-down means for an electronic ballast housing and lamp support bracket. This hold-down means is disadvantageous because of the number of components needed to assemble the lighting fixture and because of the number of operations required during the manufacturing and assembly process. Also, there is need for specialized tools and assembly fixtures to aid in the assembly process.

The following prior art discloses several mounting apparatus as used in other lighting fixtures.

U.S. Pat. No. 5,491,618, granted Feb. 13, 1996, to U. Vakil, discloses a quick connect/disconnect lighting fixture that requires no tools to install or remove after the initial installation. A typical consumer is then able to convert an existing incandescent lighting fixture to a fluorescent light fixture and maintain it after it is installed.

U.S. Pat. No. 5,130,915, granted Jul. 14, 1992, to D. W. Lerch, discloses a dome shaped decorative fixture that is marketed in kit form with its individual components easily assembled or disassembled. The dome shaped decorative lighting fixture has been designed to be mounted in a ceiling either below a skylight and/or within a housing built into the ceiling.

U.S. Pat. No. 4,029,593, granted Jun. 14, 1977, to R. A. Natoli, teaches of a twist lock lamp socket locking means that comprises a lamp socket and panel assembly that includes a socket panel opening having a plurality of equally spaced radially outwardly directed retention slots therein that receive a plurality of circumferentially spaced socket retention tabs on a lamp socket. The socket is rotatably locked in position on the panel using a spring-biased tab located at the end of each ramped surface that engages with retention slots on the panel surface.

U.S. Pat. No. 3,742,208, granted Jun. 26, 1973, to A. Mills, discloses a lighting fixture that utilizes one or more circular fluorescent lamps that is connectable to conventional screw-in or bayonet type sockets. A pair of upper and lower housing members provides a supporting enclosure for the ballast and starter components.

The prior art recited above does not teach of the novel advantages that are found in the present invention.

However there is a particular need for a lighting fixture, together with a lamp mounting assembly, that uses less components and specialized tools to assemble the fixture, which will result in less time to manufacture and assemble, as well as, reduce the cost.

Accordingly, it is therefore an object of the present invention to provide a lighting fixture having a novel rotatable ballast housing that supports a lamp source bracket.

It is another object of the present invention to provide a lighting fixture having a novel rotatable ballast housing that supports a lamp source bracket, the lighting fixture having fewer components needed to assemble the lighting fixture.

It is still another object of the present invention to provide a lighting fixture having a novel rotatable ballast housing that supports a lamp source bracket, where only conventional tools and tooling are needed to assemble the lighting fixture.

It is still yet another object of the present invention to provide a lighting fixture having a novel rotatable ballast housing that supports a lamp source bracket, where the manufacturing and assembly costs are reduced when producing said lighting fixture.

Another object of the present invention is to provide a lighting fixture having a novel rotatable ballast housing that supports a lamp source bracket, where safe operation through the secure rotational attachment of the illumination source and its related components is provided.

Additionally, it is another object of the present invention to provide a lighting fixture having a novel rotatable ballast housing that supports a lamp source bracket, where the ballast housing is drawn flat abutting the decorative base surface, while maintaining it in position with a binding frictional engagement.

A final object of the present invention is to provide a dome-shaped decorative cover that is snap-fitted into the decorative base, where three nibs subsequently hold it in place.

These as well as other objects and advantages of the present invention will be better understood and appreciated upon reading the following detailed description of the preferred embodiment when taken in conjunction with the accompanying drawings.

SUMMARY OF THE INVENTION

The present invention relates primarily to a lighting fixture having a novel attachment and engaging means, thereby reducing the number of components needed for the manufacture of the lighting fixture, concomitantly reducing the assembly time and assembly costs.

In the preferred embodiment, the attachment means is comprised of a ballast housing having a threaded portion that engages the mating threaded indentations found the base of the lighting fixture. The base of the ballast housing is inserted into the recess found in the base of the lighting fixture. By rotating the ballast housing as it is inserted into the lighting fixture base, the threaded portion of the ballast housing engages the ramped threaded depression in the lighting fixture base, thereby providing a secure attachment for the illumination source assembly.

Alternatively, the attachment means is comprised of a plurality of vanes found typically at the base of the ballast housing as used in a light source apparatus. The base of the ballast housing is inserted into the recess found in the base of the lighting fixture. By rotating the ballast housing as it is inserted into the lighting fixture base, the vanes engage the ramped screw-threadlike depressions in the lighting fixture base to provide a rapid secure attachment support for the illumination source. This attachment means also reduces the number of components needed to manuyfature and assemble the lighting fixture.

A lamp support bracket, securely attached to the end of the ballast housing opposite its mounting base, is bat-winged shaped to allow the fluorescent lamp to be positioned close to the base of the lighting fixture to permit a stylized dome-shaped cover to be snap-fitted to the base of the fixture.

The dome-shaped cover, having a circumferential ridge on its skirt, is securely held in place by snapping the cover past three nibs, spaced preferably 120 degrees apart, in the base plate.

BRIEF DESCRIPTION OF THE DRAWINGS

The present invention is pictorially illustrated in the accompanying drawings that are attached herein.

DETAILED DESCRIPTION OF THE INVENTION

Figure 1:
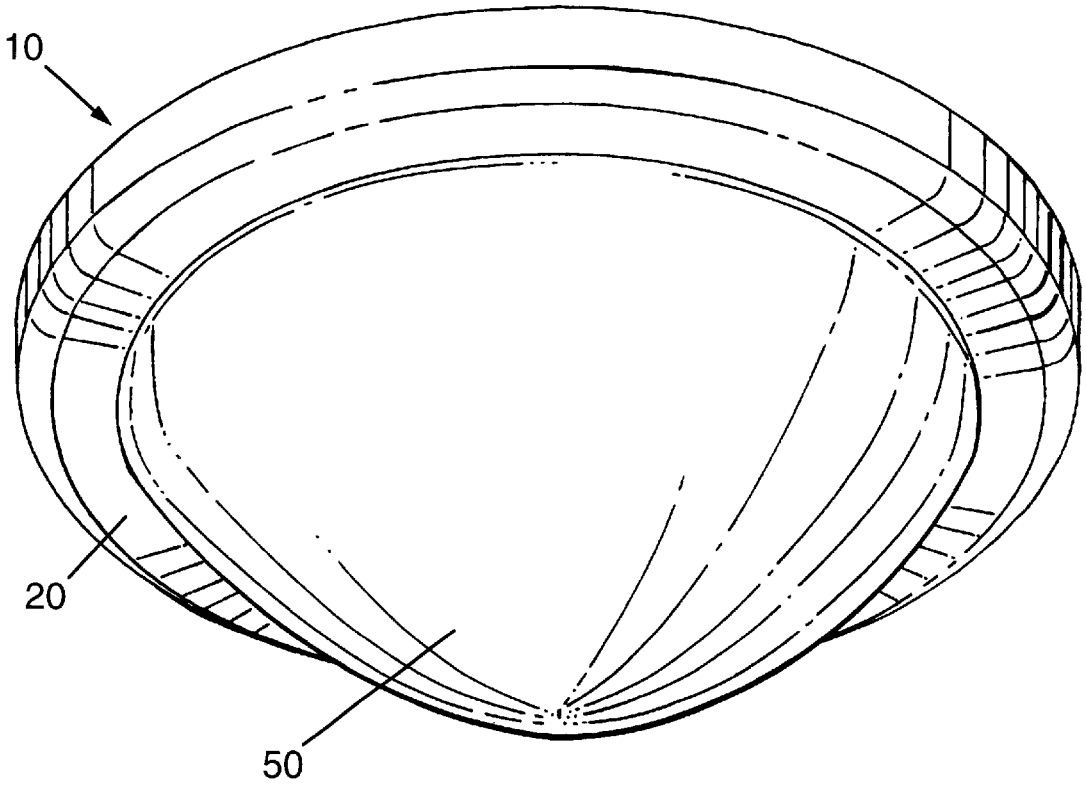
FIG. 1 is a perspective view of the lighting fixture that incorporates the present invention.

The fluorescent lighting fixture 10, embodying the principles of the present invention, is shown in FIG. 1 preferably as a ceiling mounted fixture. It may also be installed as a wall mounted fixture if so desired. The exterior components are comprised of a decorative lighting fixture base or base plate 20 and a decorative dome-shaped cover 50.

Figure 2:
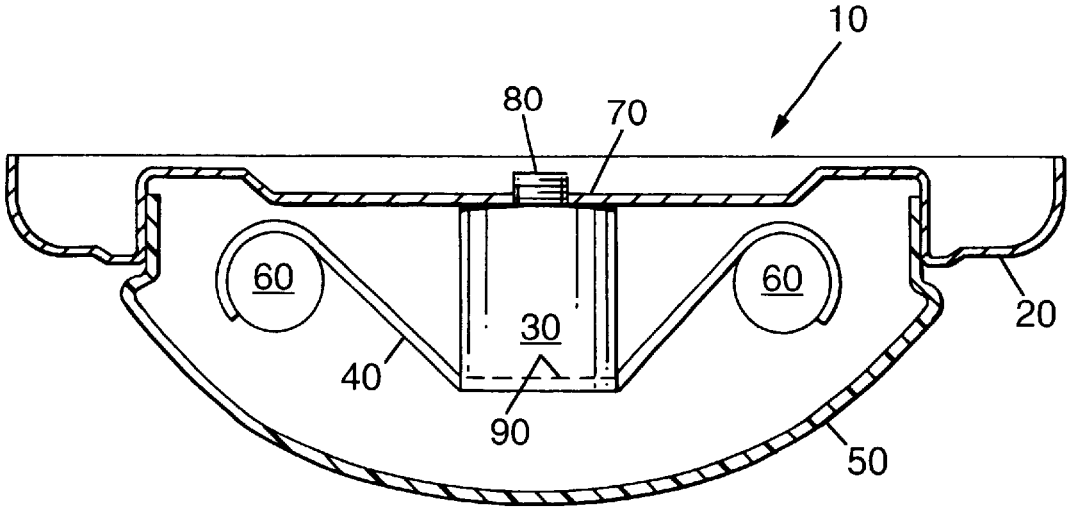
FIG. 2 is a side sectional view of the preferred embodiment of the present lighting fixture.

In FIG. 2, there is shown the screw lock base 80 of the lamp ballast housing 30 inserted into a recess 70 in the lighting fixture base 20, where it is pushed or rotatably drawn flat, abutting the surface of the fixture base into a binding frictional engagement. Snap-fitted into the slotted end of the ballast housing 30 is a bat-winged shaped lamp support bracket 40. No special tools are required to engage or remove the lamp support bracket 40 from the ballast slot 90 grooved in the ballast housing 30—only a moderate force needs to be exerted.

Figure 3:
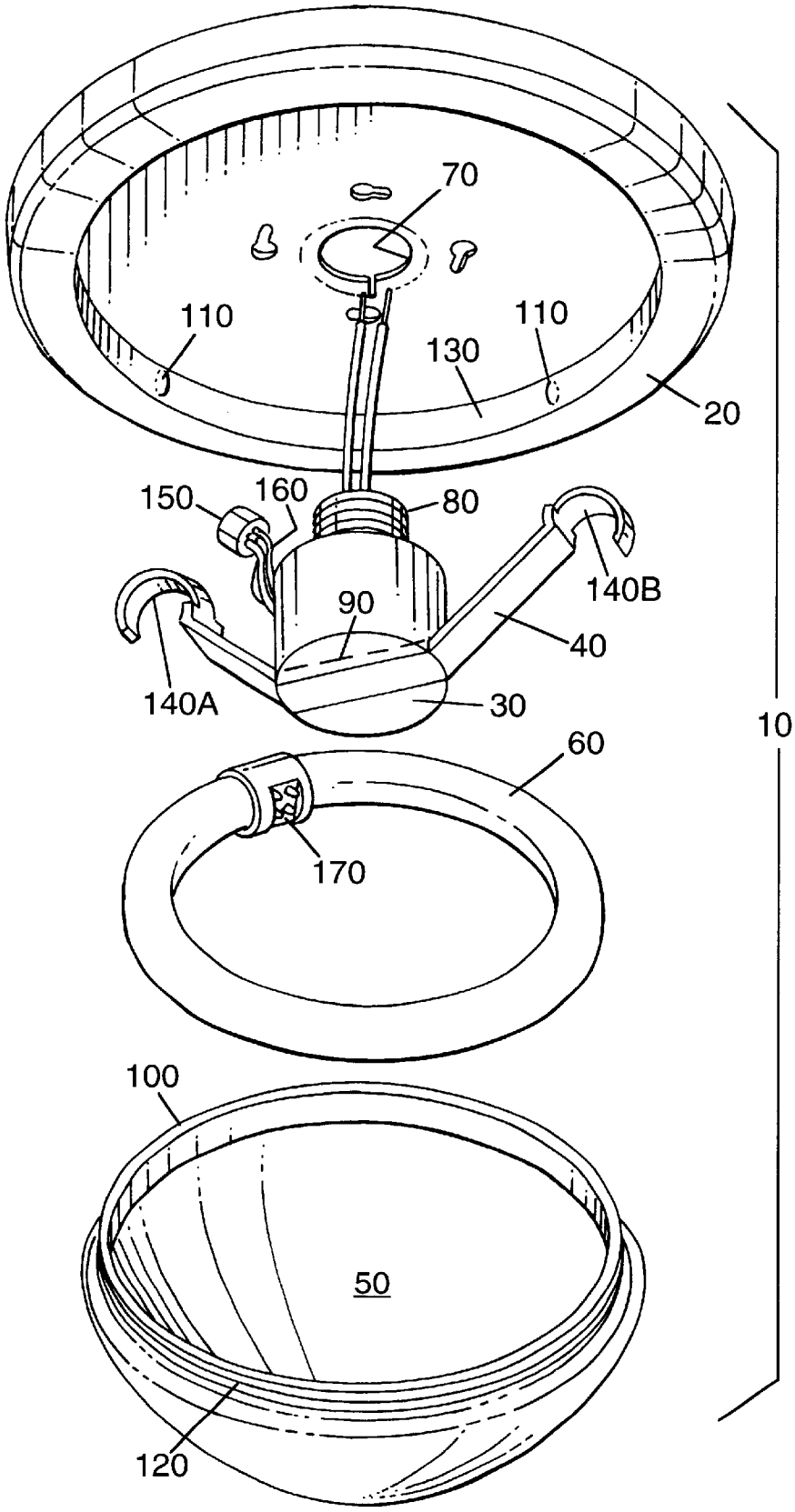
FIG. 3 is an exploded view of the lighting fixture as shown in FIG. 1.

Referring now to FIG. 3, the lighting fixture 10 is shown in an exploded view, comprising the decorative lighting fixture base 20, with the lighting assembly that includes the lamp ballast housing 30, the lamp support bracket 40, and a circular fluorescent lamp 60. Decorative dome-shaped cover 50 conceals and provides light dispersion for the light assembly.

Found at the wired first end of the ballast housing 30 is the projecting portion or boss 80 which is inserted into the hole or opening 70 located in the fixture base plate 20. The ballast housing projecting boss 80 may be radially larger to provide a frictional interfit in the opening, for removably connecting said light assembly to said base plate. And the projecting portion may include a plurality of projecting snaps fitted into a plurality of corresponding cavities on the opening, whereby the light assembly is secured to the base. For enhanced safety, however, boss 80 and the opening 70 are threaded, whereby the ballast housing of the lighting assembly is rotatably drawn against base by threads the boss 80 inserted into recessed threaded hole 70. The mean diameter of the threaded end is preferably 1.0625 inches, having 16 threads per-inch, however, any other suitable dimensions can be used. Approximately three complete turns of the ballast housing will draw the housing flat to fixture base, where it abuts the surface of the base into a binding frictional engagement, thereby preventing any further rotational tightening or removal.

The decorative dome-shaped cover 50 has a ridge 120 on its skirt or flap 100 that extends circumferentially around the outer edge of this flap—positioned so that the cover is securely held in place by snapping it past the three nibs or indentations 110 found in the interior wall 130 of the fixture base 20. The dome-shaped cover 50 is translucent and made preferably from plastic, glass or any other suitable material.

A circular fluorescent lamp 60 may be installed so that it is inserted and nested into the cradled ends 140A and 140B of the lamp support bracket 40. After the fluorescent lamp 60 is mounted in the cradled ends 140A and 140B, the four-wire plug 150 at the end of the cable 160 extending from the ballast housing 30 may be plugged into the fluorescent lamp receptacle 170.

Figure 3A:
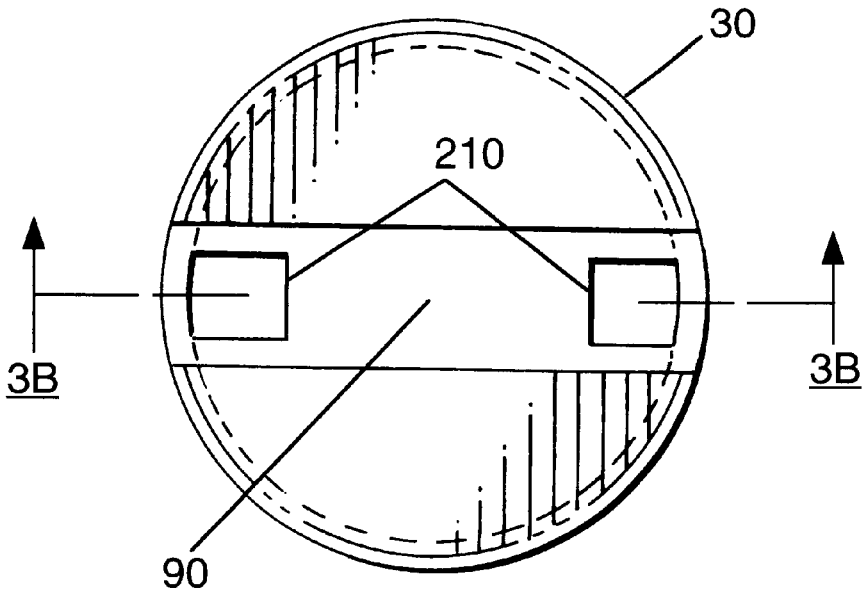
FIG. 3A is a fragmentary top view of the second end of the ballast housing detailing the rectangular holes that are used for attaching the lamp support bracket.
Figure 3B:
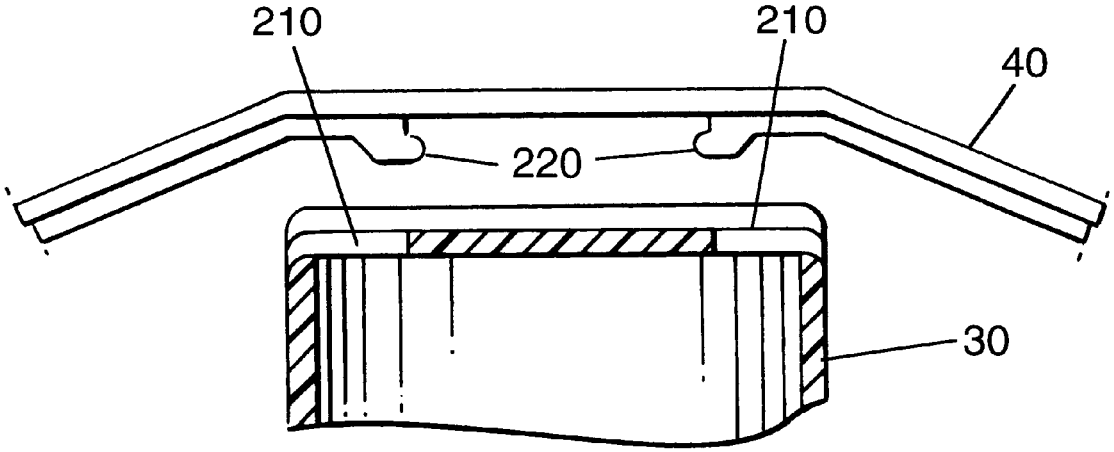
FIG. 3B is a fragmentary side sectional view along line 3B of FIG. 3A, illustrating the securement of the lamp support bracket to the ballast housing.

The bat-winged lamp support bracket 40 is mounted into slot 90 found in the second end of the ballast housing 30 and snaps into the inner surface of two square holes 210 where it is retained by the two molded clips 220 on the lamp support bracket 40, as further detailed in FIGS. 3A and 3B.

Figure 4:
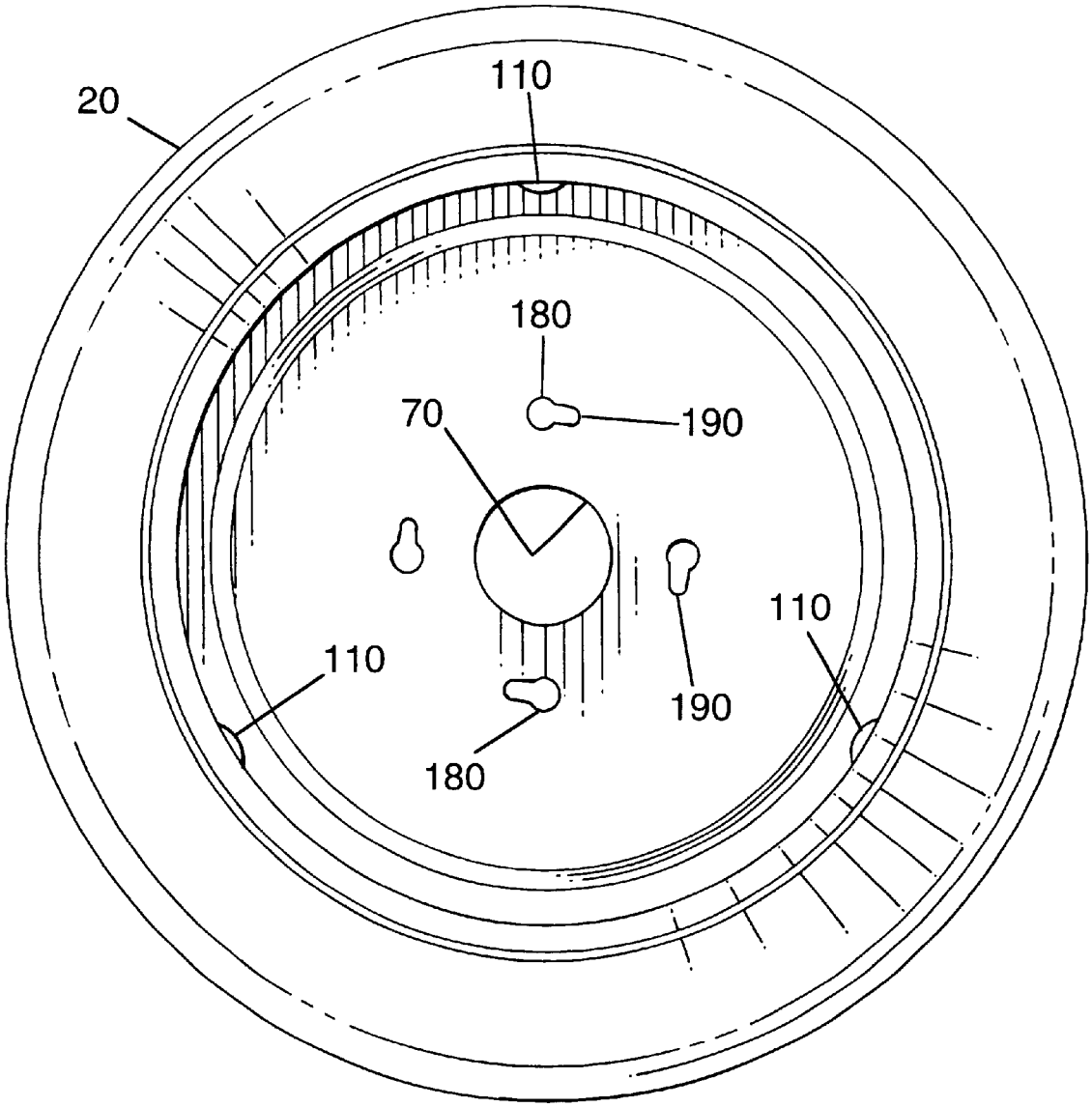
FIG. 4 is a bottom view of the base plate of the lighting fixture with first and second pairs of mounting holes for mating with an electrical junction box power supply.

Shown in FIG. 4 is the decorative base that provides the means for securing the lighting fixture base to a standard electrical junction box. Two sets of mounting holes are available for installation of the lighting fixture; the first set of mounting holes 180 mate with both a standard 4 inch octagonal or a 4 inch round box—the second set of mounting holes 190 mate with a smaller 3¼ inch octagonal or round electrical box. The base attaches to the electrical junction box by passing two round head machine screws through the appropriate set of mounting holes, either mounting holes 180 or mounting holes 190.

Figure 5:
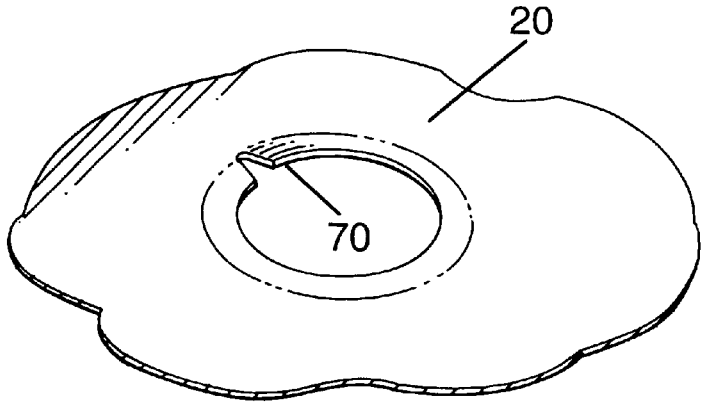
FIG. 5 is a fragmentary view of the screw lock receiving aperture in the base plate of preferred embodiment of the present invention.
Figure 6:
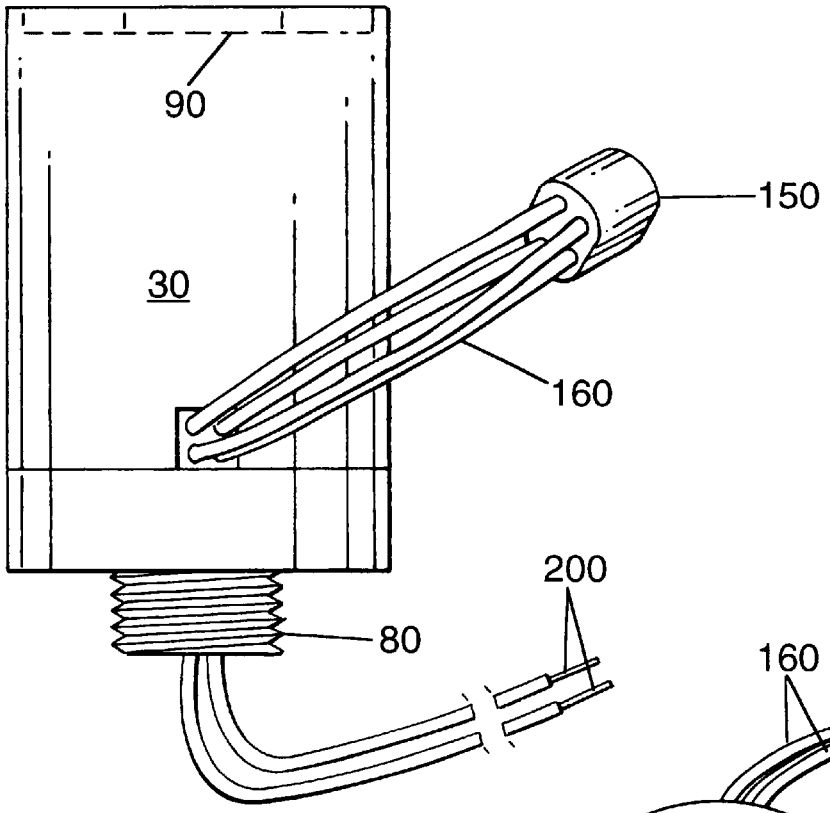
FIG. 6 is a side elevational view of a ballast enclosure detailing the threaded screw lock boss of the preferred embodiment of the present invention.
Figure 7:
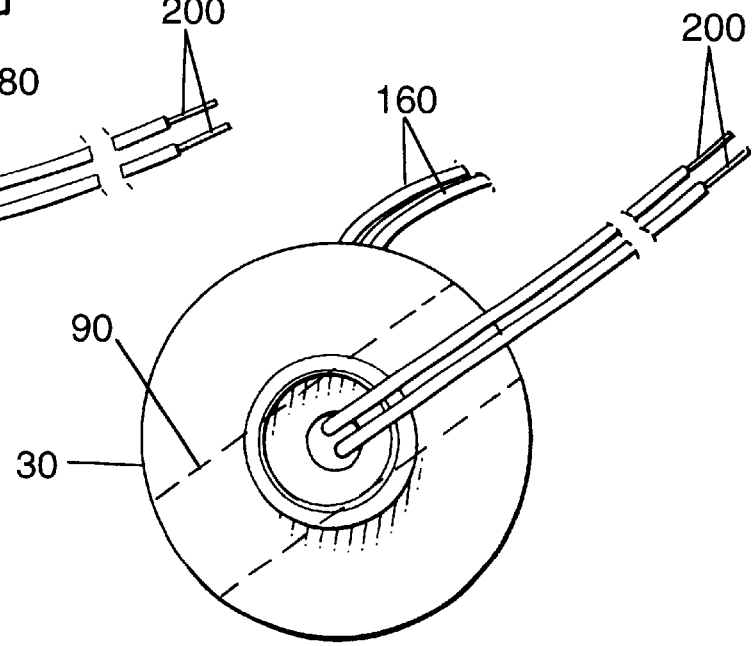
FIG. 7 is a bottom elevational view of a ballast enclosure detailing the screw lock housing of the preferred embodiment of the present invention.

Referring in particular to FIGS. 5–7, there is shown the recessed threaded hole 70 stamped into the center of the fixture base 20 into which the threaded boss 80 of the ballast housing 30 is inserted. During the time allocated for assembly, approximately only three turns of the ballast assembly are required. This is essentially a manual assembly that obviates the need for any special tools.

Because there are only three major components comprising the lighting fixture 10—the fixture base 20, the ballast 30 with lamp bracket 40, and the decorative dome-shaped cover 50, the assembly time is drastically reduced.

Even the installation is greatly simplified. First, the electrical wires 200 are connected to the household wiring and the protective earth ground wire (not shown) is attached to the earth ground wire (identified as being colored green). Second, the fixture base 20 is secured to the electrical junction box using two round head machine screws through the appropriate mounting holes, either 180 or 190. Third, a circular fluorescent lamp 60 is inserted into the lamp support bracket 40, then inserting plug 150 into fluorescent lamp receptacle 170. The decorative dome-shaped cover is then snapped into the fixture base 20, completing the installation.

Figure 8:
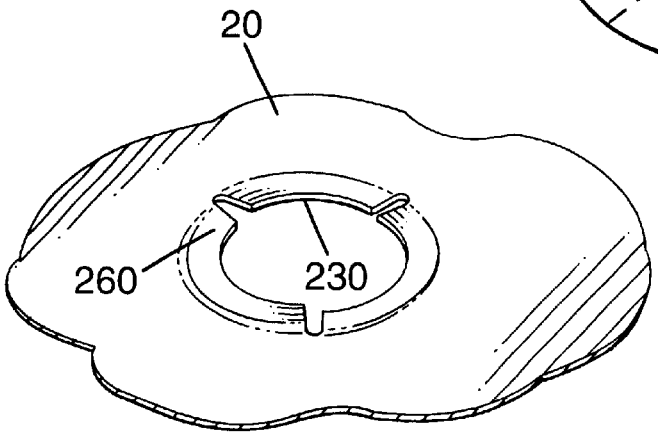
FIG. 8 is a fragmentary view of the receiving aperture in the base plate of an alternative embodiment for receiving radial vanes on the boss of a twist lock ballast housing.
Figure 9:
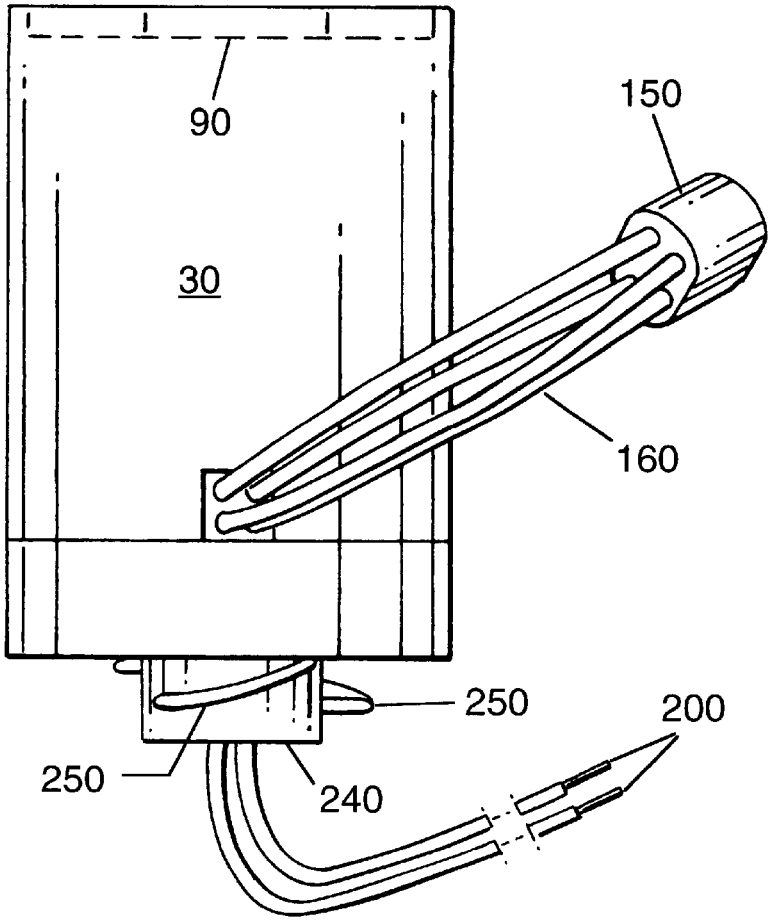
FIG. 9 is a side elevational view of a ballast enclosure detailing the twist lock vanes on the ballast housing boss in an alternate embodiment of the present invention.
Figure 10:
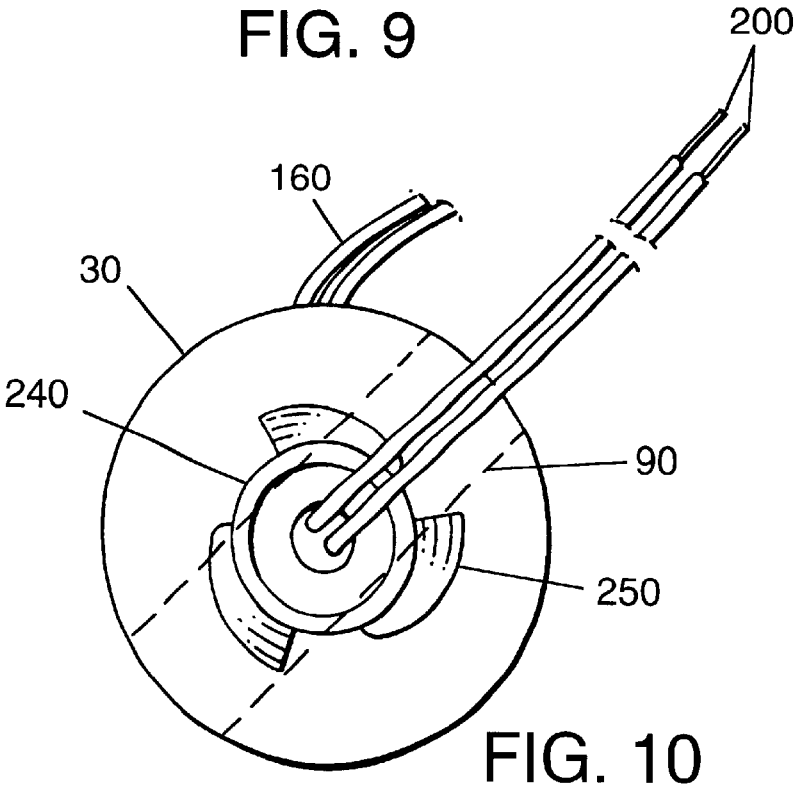
FIG. 10 is a bottom elevation view of a ballast enclosure detailing the twist lock boss with radial vanes of the alternate embodiment of the present invention.

In an alternative embodiment, as shown in FIGS. 8–10, a twist lock base is used to mount the ballast and lamp support bracket assembly. A plurality of vanes 250 found on the twist lock base 240 of the ballast housing 30 is inserted into the recess 230 found in the base 20 of the lighting fixture 10. By rotating the ballast housing 30 as it is inserted into recess 230 of the lighting fixture base 20, the vanes 250 engage the ramped screw-threadlike depressions 260 in the lighting fixture base 20 to provide a rapid secure attachment support for the illumination source. Again, as in the case of the preferred embodiment, the ballast housing 30 is rotatably drawn flat, abutting the surface of the fixture base 20 into a binding frictional engagement.

Figure 11:
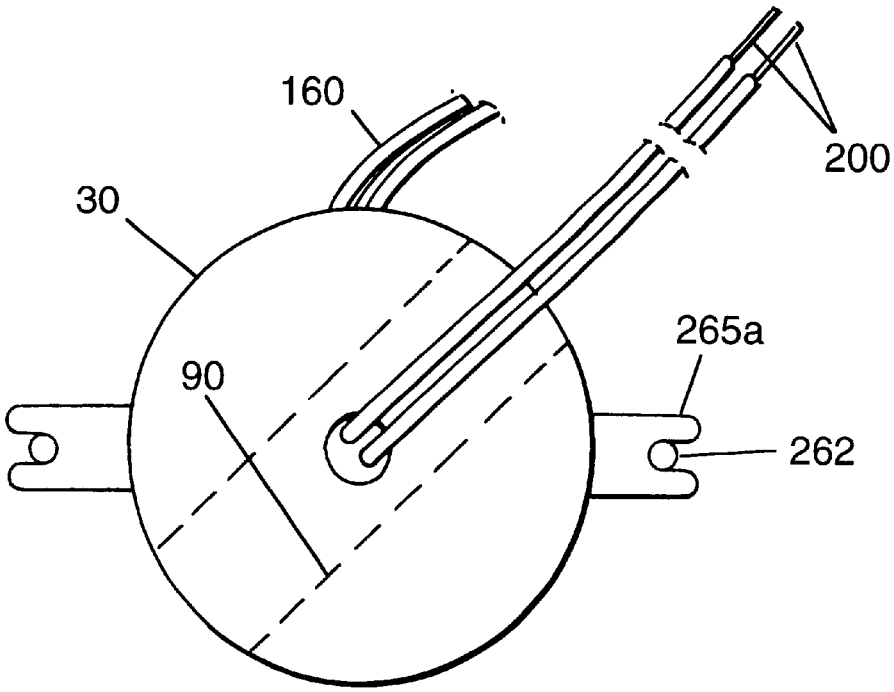
FIG. 11 is a bottom elevational view on a first end of a ballast housing connected to the fixture base using fastener screws to secure the housing feet to the base.
Figure 12:
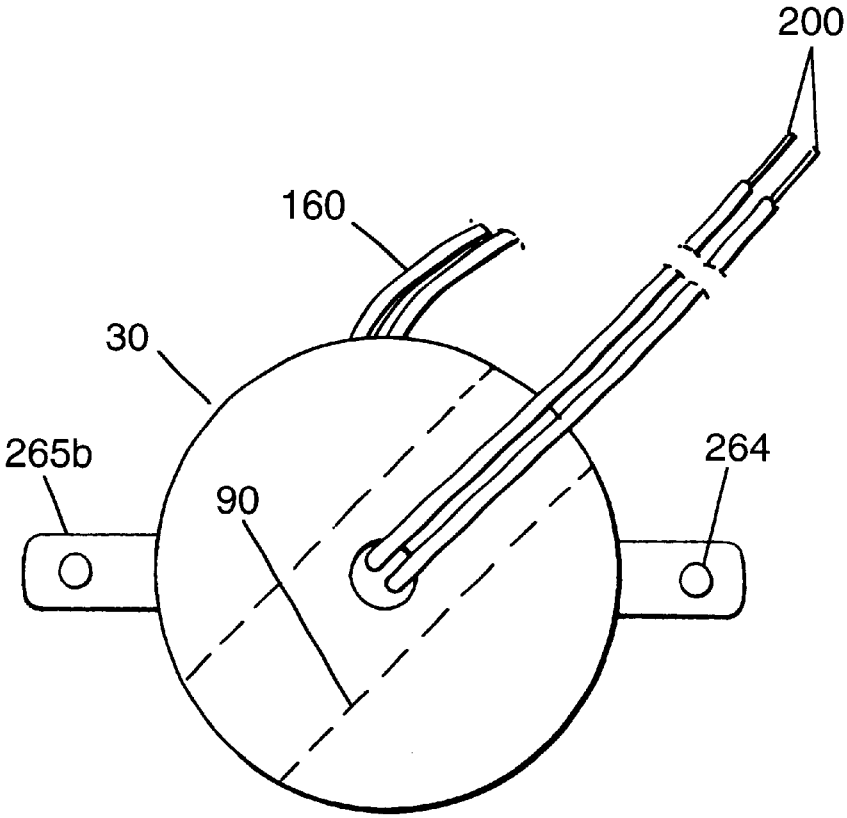
FIG. 12 is a bottom elevational view of a ballast enclosure first end detailing the ballast housing connected to the fixture base using rivets for securing each of the housing feet to the base for a tight interconnection of the housing to the base.

In FIGS. 11 and 12, the pigtail wiring exits directly from a ballast enclosure without a boss, wherein the ballast housing 30 is connected to the fixture base 20 using fastener screws 262, (FIG. 11), or rivets 264, (FIG. 12), to secure the housing feet 265 to the base.

It should be understood that there may be numerous modifications, advances or changes that can be made to the present invention, but in doing so, it is intended that they should not detract from the true spirit of the present invention.

I claim:

1. A light fixture for use with a base plate fixable to a smooth surface, comprising:

a light assembly supported on the base plate and including a lamp ballast positioned at the opening within a ballast housing having a threaded boss projecting at a first end and a flat surface surrounding the boss;

the base plate having a threaded opening, a flat surface surrounding the opening with a means for securing the base plate to the smooth surface;

wherein the boss is threaded to the base plate to removably secure the light assembly to said base plate;

a means for retaining a fluorescent lamp near the base plate said means associated with a second end of the ballast housing;

wherein the ballast housing is rotatably drawn flat abutting the flat surface of the base plate for a binding frictional engagement of the light assembly with the base plate, whereby the light assembly is secured to the base plate by a manual assembly that obviates the need for any special tools, while the light assembly is readily removable for replacing a defective ballast by twisting the ballast housing.

2. The light fixture according to claim 1, further including a cover with a snap-fitted engagement with said base plate for covering the light assembly after said assembly is removably secured to the base.

3. The light fixture according to claim 2, the cover having a flap with a ridge that extends circumferentially around an outer edge of this flap, and the base including an interior wall with a plurality of indentations, whereby the cover is securely held in place over the light assembly by snapping it past each of the plurality of indentations of the fixture base.

4. The light fixture according to claim 3, wherein the cover is translucent and dome-shaped for maximum light dispersion.

5. The light fixture according to claim 4, the base plate further comprising a first pair of mounting holes that mate with both a standard 4 inch octagonal or a round electrical junction box; and a second pair of mounting holes that mate with a smaller 3¼ inch octagonal or a round electrical junction box.

6. The light fixture according to claim 1, further comprising a dome-shaped cover having a skirt with a circumferential ridge, wherein the cover is snapped past three spaced apart mibs in the base plate.

7. The light fixture according to claim 1, the base plate further comprising a first pair of mounting holes that mate with both a standard 4 inch octagonal or a round electrical junction box; and a second pair of mounting holes that mate with a smaller 3¼ inch octagonal or a round electrical junction box.

8. The light fixture according to claim 2, the base plate further comprising a first pair of mounting holes that mate with both a standard 4 inch octagonal or a round electrical junction box; and a second pair of mounting holes that mate with a smaller 3¼ inch octagonal or a round electrical junction box.

9. The light fixture according to claim 3, the base plate further comprising a first pair of mounting holes that mate with both a standard 4 inch octagonal or a round electrical junction box; and a second pair of mounting holes that mate with a smaller 3¼ inch octagonal or a round electrical junction box.

* * * * *